US008146284B2

(12) United States Patent
Smith

(10) Patent No.: US 8,146,284 B2
(45) Date of Patent: Apr. 3, 2012

(54) COMBINATION BRUSH AND JAG WITH PATCH

(76) Inventor: Shane Patrick Smith, Los Angeles, CA (US)

( * ) Notice: Subject to any disclaimer, the term of this patent is extended or adjusted under 35 U.S.C. 154(b) by 0 days.

(21) Appl. No.: 13/121,176

(22) PCT Filed: Sep. 28, 2009

(86) PCT No.: PCT/US2009/058642

§ 371 (c)(1),
(2), (4) Date: Mar. 25, 2011

(87) PCT Pub. No.: WO2010/037047

PCT Pub. Date: Apr. 1, 2010

(65) Prior Publication Data

US 2011/0168207 A1 Jul. 14, 2011

Related U.S. Application Data

(60) Provisional application No. 61/194,867, filed on Sep. 27, 2008.

(51) Int. Cl.
*F41A 29/02* (2006.01)
*B08B 9/027* (2006.01)

(52) U.S. Cl. ..... 42/95; 15/104.09; 134/8

(58) Field of Classification Search ... 42/95; 15/104.66, 15/104.9; 134/8
See application file for complete search history.

(56) References Cited

U.S. PATENT DOCUMENTS 41,481 A 2/1864 Carr
99,557 A 2/1870 Gillette
101,997 A 4/1870 Greve
172,996 A 2/1876 Gregg
182,352 A 9/1876 Budd
184,510 A 11/1876 Davies
190,123 A 5/1877 Budd
209,276 A 10/1878 Longden
210,235 A 11/1878 Birch
276,660 A 5/1883 Birch
355,570 A 1/1887 Smith
358,304 A 2/1887 Simpson
363,951 A 5/1887 Forster
373,747 A 11/1887 Mansfield
387,410 A 8/1888 Gillette
405,297 A * 6/1889 Bailey ..... 15/104.16
449,239 A 3/1891 Webster
460,986 A 10/1891 Odell
464,843 A 12/1891 Bagger
473,821 A 4/1892 Carbis
486,331 A 11/1892 Harrison
514,514 A 2/1894 Stafford
566,041 A 8/1896 Warner
579,483 A 3/1897 Honeywell
602,937 A 4/1898 Egli
(Continued)

*Primary Examiner* — Bret Hayes
(74) *Attorney, Agent, or Firm* — Cislo & Thomas, LLP

(57) ABSTRACT

A combination brush and jag (100) comprising a stem (14), a set of short bristles (62) having a first transverse diameter (61); a set of long bristles (64) having a second transverse diameter (63); the set of short bristles (62) and long bristles (64) positioned adjacent to each other and secured in between the stem (14); and a patch (71) to cover the set of short bristles (62). The first transverse diameter (61) is smaller than the second transverse diameter (63). The first transverse diameter (61) is also smaller than the bore diameter 1 or 8 of a bore (73) so as to define a circular gap (3) approximately the size of the thickness of the patch (71).

11 Claims, 5 Drawing Sheets

U.S. PATENT DOCUMENTS

| | | | |
|---|---|---|---|
| 614,191 | A | 11/1898 | Wells |
| 619,906 | A | 2/1899 | Phillips |
| 621,857 | A | 3/1899 | Scott |
| 650,182 | A | 5/1900 | Lefever |
| 667,060 | A | 1/1901 | Carr |
| 690,393 | A | 1/1902 | Bishop |
| 707,913 | A | 8/1902 | Harrison |
| 712,266 | A | 10/1902 | Cunningham |
| 750,357 | A | 1/1904 | Gibbons |
| 753,189 | A | 2/1904 | Buckelew |
| 813,860 | A | 2/1906 | Carter |
| 821,198 | A | 5/1906 | Stocker |
| 852,748 | A | 5/1907 | True |
| 860,180 | A | 7/1907 | Aird |
| 862,824 | A | 8/1907 | Howell |
| 864,837 | A | 9/1907 | Durston |
| 877,324 | A | 1/1908 | Gilbert |
| 878,145 | A | 2/1908 | Middleton |
| 882,598 | A | 3/1908 | Ward |
| 883,985 | A | 4/1908 | Suva |
| 921,569 | A | 5/1909 | Tupes |
| 938,836 | A | 11/1909 | Fessenden |
| 940,985 | A | 11/1909 | Moore |
| 957,301 | A | 5/1910 | Buchheit |
| 959,680 | A | 5/1910 | Yerkey |
| 966,100 | A | 8/1910 | Johnson |
| 1,008,548 | A | 11/1911 | King |
| 1,015,915 | A | 1/1912 | Strickler |
| 1,022,945 | A | 4/1912 | Hughes |
| 1,043,653 | A | 11/1912 | Whoolery |
| 1,061,119 | A | 5/1913 | P'Pool |
| 1,154,369 | A | 9/1915 | Browning |
| 1,156,683 | A | 10/1915 | Schullane |
| 1,164,564 | A | 12/1915 | Yost |
| 1,164,665 | A | 12/1915 | Reeves |
| 1,172,746 | A | 2/1916 | Silverstein |
| 1,175,256 | A | 3/1916 | Gruver |
| 1,205,533 | A | 11/1916 | Heaps |
| 1,237,056 | A | 8/1917 | Kitchen |
| 1,264,290 | A | 4/1918 | Fletcher |
| 1,337,104 | A | 4/1920 | Sullivan |
| 1,421,529 | A | 7/1922 | Millhouse |
| 1,427,582 | A | 8/1922 | Cumpston |
| 1,450,037 | A | 3/1923 | Heiman |
| 1,490,038 | A | 4/1924 | Smith |
| 1,495,008 | A | 5/1924 | Feagin |
| 1,516,438 | A | 11/1924 | Inskip |
| 1,525,933 | A | 2/1925 | Haigh |
| 1,526,177 | A | 2/1925 | Olberding |
| 1,546,475 | A | 7/1925 | Cook |
| 1,556,494 | A | 10/1925 | Cooper |
| 1,560,322 | A | 11/1925 | Roberts |
| 1,591,425 | A | 7/1926 | Kingman |
| 1,610,649 | A | 12/1926 | Bair |
| 1,659,707 | A | 2/1928 | Rudolph et al. |
| 1,665,257 | A | 4/1928 | Dake |
| 1,665,961 | A | 4/1928 | Hooker |
| 1,665,988 | A | 4/1928 | Smith |
| 1,684,631 | A | 9/1928 | Lapinoja |
| 1,698,803 | A | 1/1929 | Peterson |
| 1,730,785 | A | 10/1929 | Romao |
| 1,735,277 | A | 11/1929 | Hertzberg |
| 1,745,575 | A | 2/1930 | Hooker |
| 1,766,192 | A | 6/1930 | Schlegel |
| 1,811,205 | A | 6/1931 | Lee |
| 1,872,198 | A | 8/1932 | Van Rixel |
| 1,978,853 | A | 10/1934 | Albright |
| 2,018,086 | A | 10/1935 | Parsons |
| 2,058,756 | A | 10/1936 | Ayer |
| 2,074,213 | A | 3/1937 | Deem |
| 2,146,673 | A | 2/1939 | Frisone |
| 2,174,214 | A | 9/1939 | Quinn |
| 2,194,122 | A | 3/1940 | Krams |
| 2,229,084 | A | 1/1941 | Horne |
| 2,236,123 | A | 3/1941 | Von Pierce |
| 2,259,941 | A | 10/1941 | Primeaux |
| 2,272,419 | A | 2/1942 | Meyer |
| 2,290,534 | A | 7/1942 | Cave |
| 2,299,254 | A | 10/1942 | Riney et al. |
| D134,303 | S * | 11/1942 | Hoerle ..... D4/121 |
| 2,339,123 | A | 1/1944 | Volckening |
| 2,361,395 | A | 10/1944 | Gilligan |
| 2,363,520 | A | 11/1944 | Fish |
| 2,367,900 | A | 1/1945 | Stine |
| 2,379,962 | A | 7/1945 | Hoerle |
| 2,409,916 | A | 10/1946 | Varcoe |
| 2,430,164 | A | 11/1947 | Dew |
| 2,544,290 | A | 3/1951 | Bailey |
| 2,544,847 | A | 3/1951 | Malesky |
| 2,559,376 | A | 7/1951 | Schnitger |
| 2,601,691 | A | 7/1952 | Dyer |
| 2,616,109 | A | 11/1952 | Gardner |
| 2,728,929 | A | 1/1956 | Bell |
| 2,763,081 | A | 9/1956 | Huckabee |
| 2,765,740 | A | 10/1956 | Norman |
| 2,790,987 | A | 5/1957 | Kirckpatrick |
| 2,798,238 | A | 7/1957 | Rogovin |
| 2,805,434 | A | 9/1957 | Hopkins |
| 2,824,322 | A | 2/1958 | Angelica et al. |
| 2,834,973 | A | 5/1958 | Friesen |
| 2,856,738 | A | 10/1958 | Deuschle |
| 2,867,319 | A | 1/1959 | Jones et al. |
| 2,868,299 | A | 1/1959 | Gist |
| 2,897,525 | A | 8/1959 | Goodwin et al. |
| 3,064,294 | A | 11/1962 | Stocking |
| 3,076,988 | A | 2/1963 | Mills |
| 3,085,272 | A | 4/1963 | Weichselbaum |
| 3,100,904 | A | 8/1963 | Stocking |
| 3,133,298 | A | 5/1964 | Norwood |
| 3,137,957 | A | 6/1964 | Ingalls |
| 3,147,708 | A | 9/1964 | Ferguson |
| 3,151,517 | A | 10/1964 | Guinness |
| 3,186,019 | A | 6/1965 | Hattori |
| 3,205,518 | A | 9/1965 | Romaine |
| 3,208,302 | A | 9/1965 | Lewis et al. |
| 3,209,690 | A | 10/1965 | Mercatoris |
| 3,262,557 | A | 7/1966 | Pucci |
| 3,286,293 | A | 11/1966 | Eckert |
| 3,296,644 | A | 1/1967 | Weisberg |
| 3,360,818 | A | 1/1968 | Edwards |
| 3,438,461 | A | 4/1969 | MacPherson |
| 3,476,047 | A | 11/1969 | Davis |
| 3,480,982 | A | 12/1969 | Saunders |
| 3,536,160 | A | 10/1970 | Brewer |
| 3,602,935 | A | 9/1971 | McDonnell et al. |
| 3,609,790 | A | 10/1971 | Butch |
| 3,613,664 | A | 10/1971 | Willson et al. |
| 3,708,820 | A | 1/1973 | Schultea |
| 3,716,884 | A | 2/1973 | Lavins |
| 3,739,420 | A | 6/1973 | Kafkis |
| 3,740,883 | A | 6/1973 | Kyle |
| 3,813,802 | A | 6/1974 | Di Prospero |
| 3,814,525 | A | 6/1974 | Spencer |
| 3,881,464 | A | 5/1975 | Levene |
| 3,952,359 | A | 4/1976 | Rosseau |
| 4,010,565 | A | 3/1977 | DiProspero |
| 4,030,199 | A | 6/1977 | Russell |
| 4,038,715 | A | 8/1977 | Litt |
| 4,108,162 | A | 8/1978 | Chikashige et al. |
| 4,114,504 | A | 9/1978 | Koregelos |
| 4,144,609 | A | 3/1979 | Dubs |
| 4,167,192 | A | 9/1979 | Arnold |
| 4,195,381 | A | 4/1980 | Jurich, III |
| 4,222,142 | A | 9/1980 | DiProspero |
| 4,291,477 | A | 9/1981 | Carlton |
| 4,328,632 | A | 5/1982 | Beers |
| 4,387,479 | A | 6/1983 | Kigyos |
| 4,395,943 | A | 8/1983 | Brandli |
| 4,399,627 | A | 8/1983 | Malesky et al. |
| 4,490,872 | A | 1/1985 | Drumm |
| 4,497,082 | A | 2/1985 | Kogasaka |
| 4,499,625 | A | 2/1985 | Bottomley |
| 4,503,578 | A | 3/1985 | McIntyre |
| 4,509,223 | A | 4/1985 | Sipple et al. |
| 4,547,924 | A | 10/1985 | Brygider |
| 4,674,218 | A | 6/1987 | Bottomley |
| 4,680,824 | A | 7/1987 | Lieptz |

4,691,404 A 9/1987 Tarrson et al.
4,716,673 A 1/1988 Williams et al.
4,726,137 A 2/1988 Zurek et al.
4,756,044 A 7/1988 Clark
4,776,125 A 10/1988 Black et al.
4,803,792 A 2/1989 Brown, Jr. et al.
4,843,750 A 7/1989 Blase
4,850,071 A 7/1989 Lawrence
4,866,871 A 9/1989 Rivers
4,873,778 A 10/1989 Stipp
4,889,106 A 12/1989 Watanabe
4,901,464 A 2/1990 Banoun
4,901,465 A 2/1990 Hsu
4,930,240 A 6/1990 Bice
4,949,496 A 8/1990 Stephan
4,962,607 A 10/1990 Baldwin
5,038,509 A 8/1991 Stephan
5,060,336 A 10/1991 LaLonde
5,074,074 A 12/1991 Yeadon
5,075,998 A 12/1991 Selleck
5,127,179 A 7/1992 Marsh
5,168,593 A 12/1992 Poje et al.
5,171,925 A 12/1992 Mekler
5,233,128 A 8/1993 Lai
5,297,310 A 3/1994 Cox et al.
5,318,052 A 6/1994 Ivanov
5,337,505 A 8/1994 Brown et al.
5,378,499 A 1/1995 Martin et al.
5,394,584 A 3/1995 Breitschmid
5,402,548 A 4/1995 Adair et al.
5,437,073 A 8/1995 Smith
5,557,871 A 9/1996 LaLonde
5,588,242 A 12/1996 Hughes
5,651,207 A 7/1997 Knight
D393,115 S 3/1998 Bell et al.
5,743,040 A 4/1998 Kennedy
5,775,020 A 7/1998 Baird
5,775,021 A 7/1998 Weiss
5,777,381 A 7/1998 Nishida
5,815,975 A 10/1998 Rambo et al.
5,871,589 A 2/1999 Hedge
5,934,000 A 8/1999 Hayes, Sr.
5,972,125 A 10/1999 Hedge
5,983,550 A 11/1999 Skaar
6,088,866 A 7/2000 Hedge
6,260,927 B1 7/2001 Sajakorpi et al.
6,269,579 B1 8/2001 Warner
6,378,236 B1 4/2002 Solberg et al.
6,389,978 B1 5/2002 Hooper et al.
6,630,034 B1 10/2003 Schnell
6,640,480 B2 11/2003 Williams et al.
6,668,480 B1 12/2003 Riley
6,701,657 B1 3/2004 Hudspeth
6,701,658 B1 3/2004 Brownell
7,020,994 B2 4/2006 Buie, II
7,073,286 B2 7/2006 Paananen et al.
7,131,381 B1 11/2006 Nafziger
7,165,673 B2 1/2007 Marks
7,254,860 B2 8/2007 Dumler et al.
7,356,961 B2 4/2008 Williams
7,367,151 B1 5/2008 Black et al.
2002/0065031 A1 5/2002 Chou et al.
2002/0129725 A1 9/2002 Bice et al.
2004/0111948 A1 6/2004 Schnell
2005/0252405 A1 11/2005 Deskins
2006/0010753 A1 1/2006 Buie
2006/0130251 A1 6/2006 Bourrelly
2006/0218735 A1 10/2006 Parker-Smith
2006/0236584 A1 10/2006 Williams
2006/0277811 A1 12/2006 Peterson
2007/0051027 A1 3/2007 Stordal
2007/0240353 A1 10/2007 An
2007/0261288 A1 11/2007 Perry et al.

* cited by examiner

Fig. 1
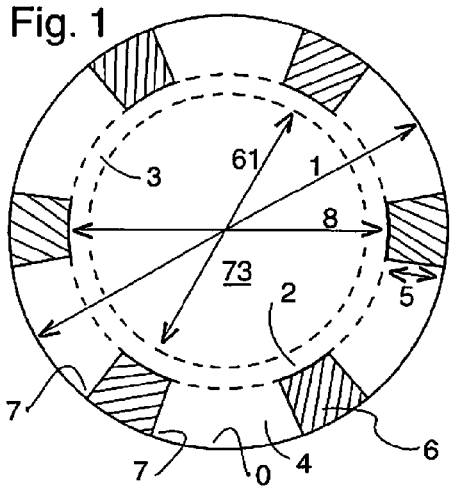
Fig. 2
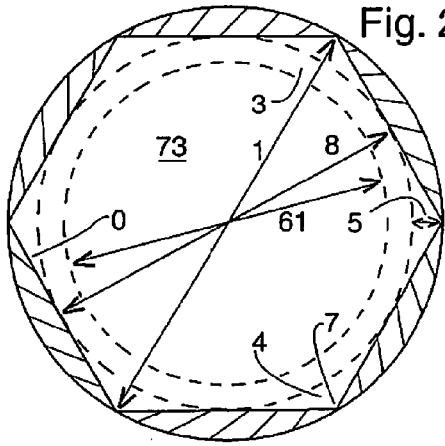
Fig. 3
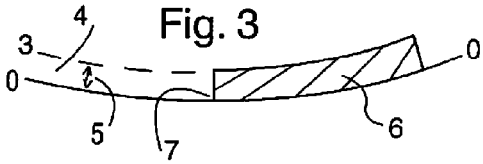
Fig. 4
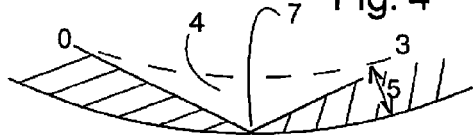
Fig. 5
(Prior Art)
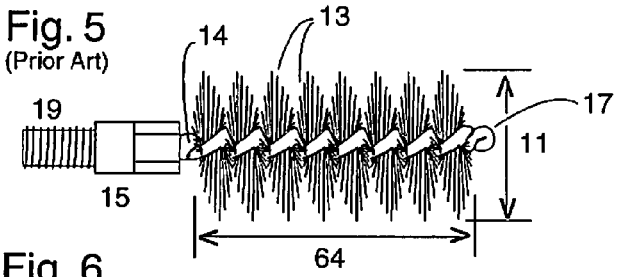
Fig. 6
(Prior Art)
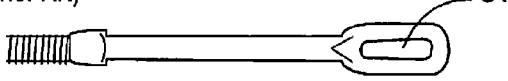
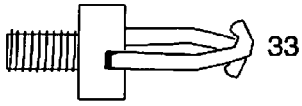
Fig. 7
(Prior Art)
Fig. 8
(Prior Art)
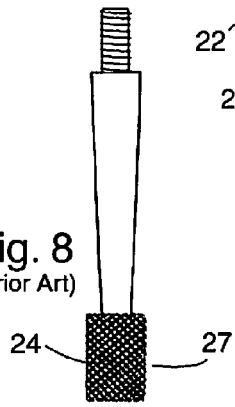
Fig. 9
(Prior Art)
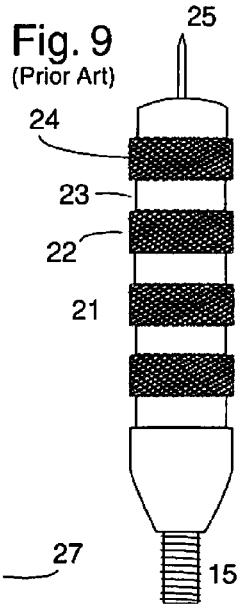

COMBINATION BRUSH AND JAG WITH PATCH

TECHNICAL FIELD

This invention relates to a combination brush and jag to clean gun barrels and other bores and pipes.

BACKGROUND

A bore or pipe must be cleaned, polished, lubricated, and preserved in order to allow for the free and ideal flow of projectiles, liquids, gases, or particulate matter that go through it. The process extends the life of a barrel, pipe, or flue, or extends the life of a device connected to it. In the case of firearms, cleaning a bore improves the accuracy of projectiles shot from it. A firearm bore is lubricated and treated in order to preserve the integrity of the metallic inner wall, grooves, and lands. Undesirable wear and tear of the firearm bore include oxidation of the bore's surface, chemical pitting of the bore, and physical scratching of the bore due to projectiles trapping residual particles.

Properly maintaining the bore usually requires the two separate actions of brushing and wiping of the bore. The brushing step is accomplished with a brush having a uniform transverse diameter as shown in FIG. 5 while the wiping step is accomplished by inserting a patch into the bore with one of the jags shown in FIGS. 6-9. A brush with a transverse diameter that is slightly larger than the bore's inner diameter is used to brush the bore and scrape grime loose that has been baked on or chemically bonded to the inner wall or lands. After the brushing procedure is finished, a jag with a patch is used to wipe grime out of the bore.

Most cleaning devices for the barrels of firearms are single-purpose devices, meaning the cleaning device is used either for scraping residues off the inside of the barrel or for wiping and lubricating the inside of the barrel. To perform both functions, a user would require two separate cleaning devices, a brush to scrape, and a jag to wipe.

In addition, cleaning devices may be single-action, meaning that the device is sent through the bore in a single direction. In single-action cleaning devices, the device is either pushed or pulled through the barrel. However, due to the design, the device cannot be pushed and pulled repeatedly inside the gun barrel. Thus, cleaning the barrel can be a slow laborious process.

Single-action cable systems and pulled-only series systems have a long reloading time between strokes, and people in the market report that they use pulled-only systems when they want to clean quickly but not thoroughly. Prior art spiral brushes attached to rods make it easier to clean thoroughly because brushing strokes may occur with no time delay between strokes, and the time saved makes it more likely for a user to run the brush through the bore many times.

FIG. 6 shows prior art jags for firearms that are loops, eye-lets, or slots, through which a patch is drawn halfway. Some jags are twists of wire extending from the jag's front-end through which a parch is drawn and pinched or punctured as shown in FIG. 7. The jag is capable of holding the patch to perform successive strokes without having to re-load a patch. The patch, however, is not distributed symmetrically around the jag, and the result is that these jags do not press the patch evenly against the wall of the bore. Some grime can be bypassed or missed on any pass down the bore. Another disadvantage of these jags is that when using regular non-abrasive fabric, the jag-patch combination wipes but does not brush and is again not dual purpose.

Thus, there are some cleaning devices that are dual-purpose but not dual-action or dual-action but not dual-purpose. However, these devices only have a single transverse diameter that is either too large to add a patch or two small to apply constant and even pressure against the walls of the barrel.

For the foregoing reasons there is a need for a combination brush and jag that has the dual-purpose of scraping and wiping and has dual-action of being capable of being pushed and pulled through the bore in repeated strokes while maintaining constant and even pressure on the bore wails so as to make cleaning a gun barrel or other types of bores and pipes more efficient.

SUMMARY

The present invention is directed to a cleaning device in the form of a combination brush and jag that has the dual-purpose of brushing and wiping a bore and has the dual-action of being capable of being pushed and pulled through the bore in repeated strokes so as to make cleaning a gun barrel or other types of bores and pipes more efficient. The combination brush and jag comprises a stem securing a set of long bristles and a set of short bristles adjacent to the set of long bristles and a patch to wrap around the set of short bristles. The set of short bristles has a transverse diameter that is precisely dimensioned to be slightly smaller than the diameter of the inner wall of a bore, such that a gap is created that is approximately the same thickness as the patch. The set of long bristles are dimensioned to contact the inner wall of the bore when the combination brush and jag are inserted into the bore. Due to the two different transverse diameters of two different sets of bristles, the precise dimensioning of the transverse diameters, and the application of a patch to the set of short bristles, the brush and jag combination has the dual purpose of serving as a brush and a jag, and has the dual action of being inserted into the bore and pulled out of the bore without losing the patch while the set of short bristles apply even and uniform pressure to the patch against the inner wall of the bore.

BRIEF DESCRIPTION OF DRAWINGS

FIG. 1 shows a cross-section of a bore;

FIG. 2 shows a cross-section of another bore;

FIG. 3 shows a close-up cross-sectional view of an edge of the type of bore shown in FIG. 1;

FIG. 4 shows a close-up cross-section view of an edge of the type of bore shown in FIG. 2;

FIG. 5 shows a prior art brush for brushing a bore;

FIG. 6 shows a prior art jag;

FIG. 7 shows another prior art jag;

FIG. 8 shows another prior art jag;

FIG. 9 shows another prior art jag;

DETAILED DESCRIPTION OF THE INVENTION

Figure 10:
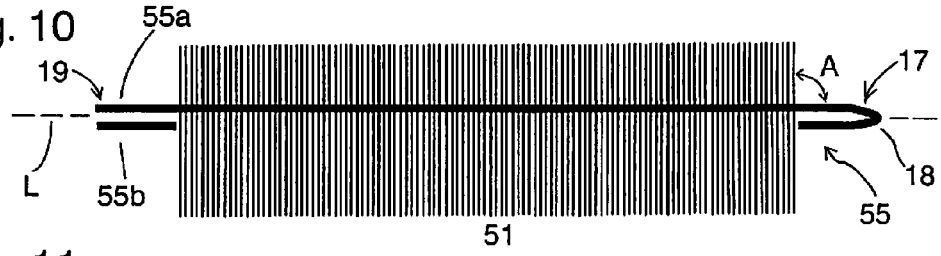
FIG. 10 shows a side view of an embodiment of the present invention prior to securing the bristles by twisting the wires.

The detailed description set forth below in connection with the appended drawings is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. It is to be understood, however, that the same or equivalent functions and sequences may be accomplished by different embodiments that are also intended to be encompassed within the spirit and scope of the invention.

The combination brush and jag 100 is directed towards a multi-purpose cleaning device for cleaning, wiping, scraping, brushing, polishing, lubricating, and/or protecting bores, chambers, and other holes or cavities of small hand-held, firearms, including muzzleloaders, paintball guns, and of larger caliber weapons such as artillery. The combination brush and jag 100 may also be used for cleaning, wiping, scraping, brushing, polishing, lubricating, or protecting exhaust flues, chimney flues, valve bores, boiler pipes, furnace pipes, refrigerator pipes, radiator pipes, air ducts, or any pipes used for transport of fluids composed of liquid, gas, or particulate matter. The combination brush and jag 100 is configured for dual-action of being pushed and pulled through the bores and dual-purpose of brushing and wiping for effective and efficient cleaning.

An example of a bore 73 may be the barrel of a gun as shown in FIGS. 1 and 2. The typical gun bore 73 has an inner wall 0 having a diameter 1. Often times the gun bore 73 may have a rifling created by cutting a twisting groove along the length of the bore 73 to create raised lands 6 circumferentially spaced apart that also twist down the bore 73 to create a helical pattern. The rifling causes the bullets to spiral to improve accuracy and distance of the bullet when shot out of the gun, but causes difficulty in cleaning the bore 73. Another type of rifling is made by creating a bore 73 having a polygonal cross-section as shown in FIG. 2. The distance from one raised land 6 to an opposite raised land is the land-to-land diameter 8. The bore, therefore, has a bore (all defined by either the inner wall 0 or the lands 6 and the bore diameter BD may be either the inner all diameter 1 or the land-to-land diameter 8.

Figure 12:
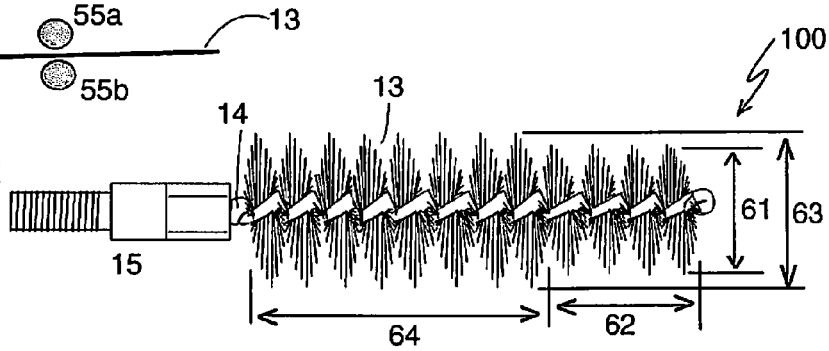
FIG. 12 shows an embodiment of the present invention.

As shown in FIG. 12, the combination brush and jag 100 comprises a stem 14, a first set of bristles 62 having a first transverse diameter 61; a second set of bristles 64 having a second transverse diameter 63, the first set of bristles 62 and second set of bristles 64 positioned adjacent to each other and secured in between the stem 14; and a patch 71 to cover the first set of bristles 62. The stem 14 secures the bristles 13 in place, the second set of bristles 64 serves as a brush portion, and the first set of bristles 62 serves as the wiping portion on the jag portion.

The stem 14 is an elongated wire 55 designed to secure the bristles 13 in place. The stern 14 has a first end 17 and a second end 19 opposite the first end 17. In some embodiments, the stem 14 is made from a single wire 55. The wire 55 may be bent upon itself to define a first wire stem 55*a*, a second wire stem 55*b* parallel to the first wire stem 55*a*, a bend 18 at the first end 17 connecting the first and second wire stems 55*a*, 55*b*, and a longitudinal axis L parallel to the first and second wire stems 55*a*, 55*b*. The first and second set of bristles 62, 64 are positioned in between the first and second wire sterns 55*a*, 55*b* as shown in FIG. 1 and fixed in place by twisting the first and second wire stems 55*a*, 55*b* about each other along the longitudinal axis L, thereby forming a double helix with the bristles 13 projecting away from the stem 14.

Figure 23:
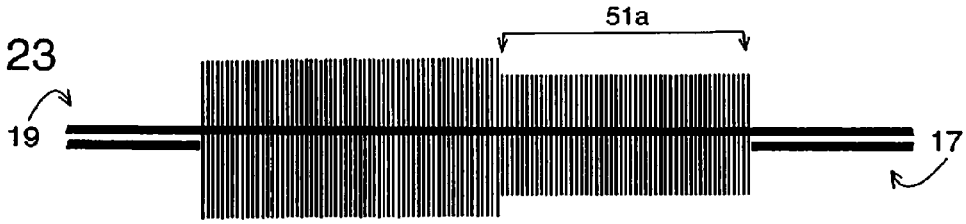
FIG. 23 shows a side view of the bristles and stem before the completion of the assembly.

The number of wires 55 in the twisted-wire stem 14 may vary. The stem 14 may be made using more base wires 55 in order to increase the strength of the stem 14. For example, if two bent base wires are used, the stem 14 would be made from four wire steins twisted together. In some embodiments, two separate wires, as shown in FIG. 23, may be twisted about each other to form a double helix with the first and second set of bristles 62, 64 secured in between the two wires. In such an embodiment, the first end 17 of the stem may be capped or finished to provide a smoother surface.

In some embodiments, the stem 14 may be longer than the standard barrel brush. For example, the stem 14 may be twice as long as the standard brush, with the brush portion 64 and jag portion 62 being of equal lengths. Having a longer stem 14 increases the chances of the stem 14 warping and bending out of shape when it is pushed inside the entrance of the bore 73. To prevent such bending and warping, the stem 14 may be strengthened during manufacture.

One way to strengthen the stem 14 would be use of a harder temper metal or composite for base wire 55 by using different metal composition and grade, synthetic composition and grade, composite composition and grade, or varying the density or diameter of the stem. Typical metals used for base wire 55 include carbon steel, such as galvanized steel and stainless steel, aluminum, and brass. However, when a metal is too hard, it is brittle and susceptible to cracking when twisted. To prevent cracking of a hard temper metal a high temper carbon steel may be twisted along with filaments before the wire stem 14 is fully hardened while it is being annealed.

Figure 13:
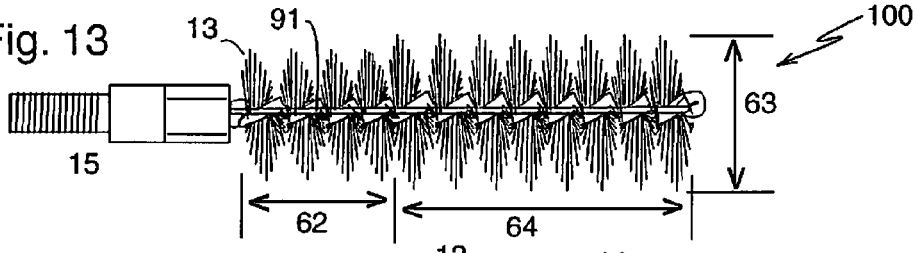
FIG. 13 shows another embodiment of the present invention.
Figure 14:
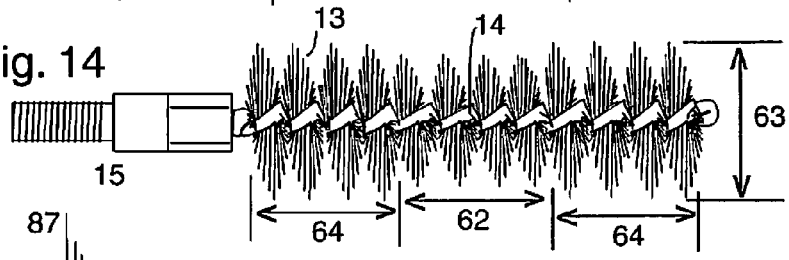
FIG. 14 shows another embodiment of the present invention.

In another embodiment, after the wire 55 is twisted, a guide 91 may be attached along the length of the twisted-wire stem 14 to strengthen the stem 14 as shown in FIG. 13. In some embodiments, the guide 91 may be twisted with the wires.

The characteristics of the wire 55 can also be altered by coating the wire 55 to increase rigidity, flexibility, or the ability to hold bristles 13 in place.

In some embodiments, the stein 14 may be hollow and comprise a plurality of pores through which fluids may be distributed to the bristles 13, via capillary action or a pump.

The bristles 13 or filaments are designed to perform two separate functions, brushing and wiping. The bristles 13 can vary in density, temper, metal composition and grade, natural fiber composition and grade, synthetic composition and grade, and composite composition and grade. For examples, bristles 13 may be made of any temper or grade of stainless steel, metal, phosphor bronze, brass, copper, animal hair, natural fiber, synthetic, nylon, absorbent, abrasive nylon, micro-tubes, Teflon®, Tynex ®, nanotubes, and nanoparticles. In some embodiments, the bristles 13 may be hollow to transmit fluids through the bristles. In some embodiments, the bristles 13 may comprise a pore at the tip to allows the fluid to escape the bristle and coat the outside of the brisk.

To accomplish the dual function, two separate sets of bristles are secured to the stem. The first set of bristles 62 may comprise short bristles and the second set of bristles 64 may comprise long bristles. The terms long and short describe the length of the bristles relative to each other. The set of short and long bristles 62, 64, once secured to the stem 14, each have a transverse diameter, wherein the transverse diameter 63 of the long bristles 64 is greater than the transverse diameter 61 of the short bristles 62. The transverse diameter is the average length of all of the bristles 13 in a set of bristles measured from one tip of the bristle 13 to its opposite tip, where each individual bristle 13 in each set is approximately the same length and positioned similarly on the stem 14 as shown in FIG. 10.

In general, the individual bristles 13 are straight filaments. The bristles 13, however, can be sinusoidal, bent, wavy, or any other shape so long as the proper gap space 3 is created when the brush and jag combination 100 is positioned concentrically to the base 73.

In some embodiments, the length of the individual bristles within a set is approximately the same. Therefore, when the bristles 13 are secured to the stem 14, the bristles 13 form a cylindrical shape with a circular cross section along the stein 14, wherein the diameter of the circular cross-section defines the transverse diameter 61 or 63. While the transverse diameters of individual bristles 13 fluctuate, the average of the individual transverse diameters after twisting is the brush's transverse diameter 61 or 63. Fluctuations may be due to imprecision during manufacturing, and not necessarily due to an end goal or purpose. However, fluctuations in the lengths of individual bristles may be desired in other embodiments. Typical error fluctuations for phosphor bronze brushes differ from an average radius by an amount ranging from 0.0020 inch to 0.0070 inch for all caliber, where the radius is defined by the distance from the tip of a bristle to the stem 14. In some embodiments, the error fluctuations differ from an average radius by an amount ranging from 0.0020 inch to 0.0040 inch. The error fluctuations of larger caliber, such as 45 and shotgun, may differ from an average radius by an amount as large as 0.0110 inch. It is worth noting that the amounts given are much less than an average patch thickness, which range from 0.0130 to 0.0220 inches. In other words, prior art brushes are not constructed to make room for a patch to fit between its bristle tips and bore wall 0.

Thus, the brush and jag combination 100 has at least two sets of bristles 62, 64, wherein the transverse diameter 61 of the first set 62 does not equal the transverse diameter 63 of the second set 64. More specifically, the set of long filaments 64 are made so that its average transverse diameter 63 is greater than or equal to the bore diameter. This allows the set of long bristles 64 to perform a brushing or abrasive action on the bore.

The set of short bristles 62 is designed for the wiping function. Unlike prior art jags, the use of bristles 13 allows the brush and jag combination 100 to hold the patch this the dual-action stroke while applying constant and even pressure against the bore wall. The set of short filaments 62 are made so that its transverse diameter 61 is less than the bore's inner will diameter 1 or land-to-land diameter 8, thereby defining a cylindrical gap 3 between bristle tips and the bore's inner wall 0 or lands 6 when the brush and jag combination 100 is concentrically aligned with the bore 73. The size of the gap 3, or the distance between the bristle tips and the inner all 0 or lands 6 of the bore 73 when the brush and, jag combination 100 is concentrically aligned inside the bore 73, may be approximately the same size as the thickness of the patch 71. The patch 71 can then be wrapped around the set of short bristles 62 and still have the brush and jag combination 100 fit inside the bore. Due to the tight fit, the patch 71 then performs a wiping action on the bore 73.

The set of short bristles 62 and the set of long bristles 64 may be arranged relative to each other in a variety of ways as shown in FIGS. 12-15. In some embodiments, there may be one set of long bristles 64 and one set of short bristles 62 adjacent to the set of long bristles 64. The set of long bristles 64 may be adjacent to the first end 17 nearest the bend 18 with the set of short bristles 62 adjacent to the second end 19. Alternatively, the set of short bristles 62 may be adjacent to the first end 17 with the set of long bristles 64 adjacent to the second end 19. Having the set of short bristles 62 at the first end 17 may be ideal when pushed and pulled by rods, while having the set of short bristles 62 in the second end 19 may be ideal when pulled by cables.

In some embodiments, the set of short bristles 62 may be in between two sets of long bristles 64, with the first set of long filaments adjacent to the first end 17 and a second set of long filaments adjacent to the second end 19 as shown in FIG. 13. In some embodiments, a set of long bristles 64 may be in between two sets of short bristles 62 with a first set of short bristles adjacent to the first end 17 and a second set of shirt bristles adjacent to the second end 19. In some embodiments, there may be multiple sets of short bristles 62 and long bristles 64 arranged in series in alternating fashion.

In embodiments having at least two sets of short bristles 62, two different types of patches may be applied to each set. For example, one set of short filaments 62 may be wrapped with a wiping patch and the second set of short filaments may be wrapped with an abrasive polishing patch 71.

Figure 24:
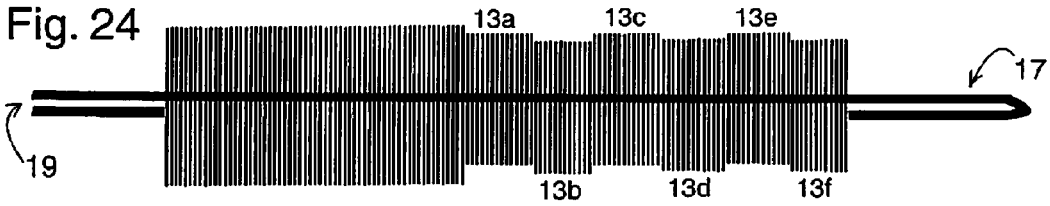
FIG. 24 shows a side view of another embodiment of the bristles and stem before the completion of the assembly.

In some embodiments, each bristle 13 in a set of bristles may not be uniform in size or may not be uniformly arranged on the stein 14 as shown in FIGS. 23-30. For example, in one embodiment, the bristles 13 may be uniform in size but positioned offset from each other forming, abrupt changes in the distance from the tip of a bristle to the stem from one bristle to the next. In some embodiments, a set of bristles may comprise multiple groups of bristles 13*a*-13*h* of the same length, wherein one group is positioned on the stem offset from an adjacent group as shown in FIG. 24. The offset groups within a set may be aligned in series with the offsetting being reversed from one group to the next, thereby forming a staggered appearance or a jagged shape with teeth that mimic the structure of solid ribbed jags 21.

Figure 25:
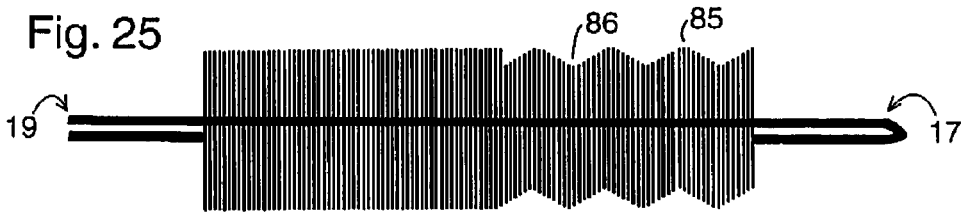
FIG. 25 shows a side view of another embodiment of the bristles and stein before the completion of the assembly.

In some embodiments, a set of bristles 13 may be uniform in length but gradually offset more and more in the same direction from one bristle to the next as shown in FIG. 25. The direction of the offsetting may be reversed at least once and preferably multiple times so as to form a sinusoidal wave configuration or jagged-shape with rounded teeth.

Figure 26:
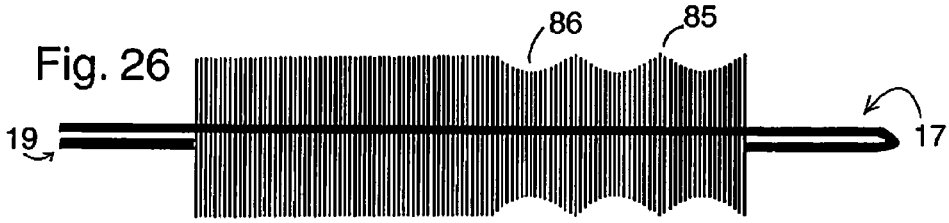
FIG. 26 shows a side view of another embodiment of the bristles and stem before the completion of the assembly.
Figure 29:
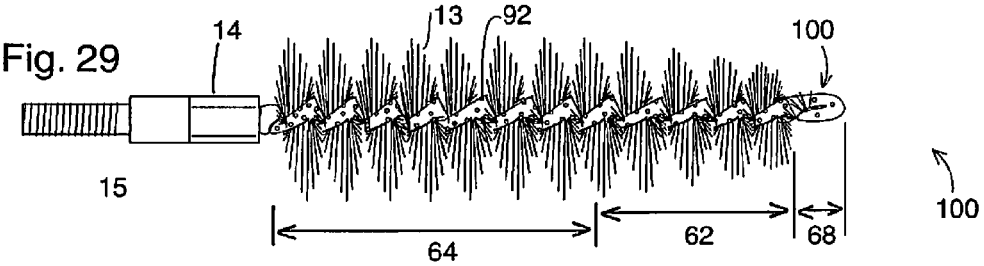
FIG. 29 shows an embodiment of the present invention.
Figure 30:
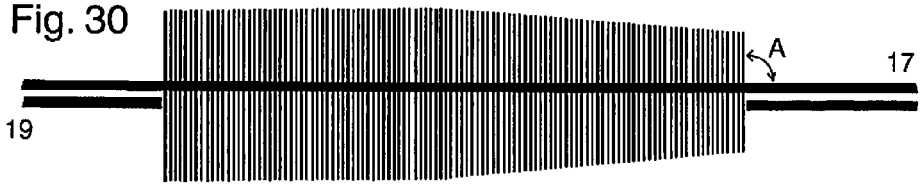
FIG. 30 shows a side view of another embodiment of the bristles and stem before the completion of the assembly.
Figure 32:
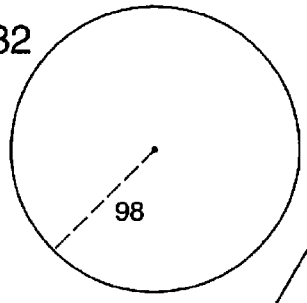
FIG. 32 shows another embodiment of the patch.
Figure 31:
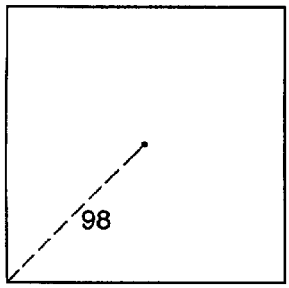
FIG. 31 shows an embodiment of the patch.
Figure 33:
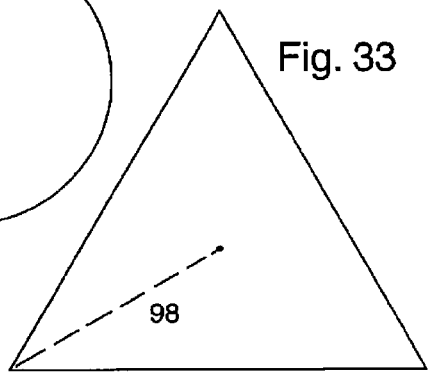
FIG. 33 shows another embodiment of the patch.

In some embodiments, the length of each bristle 13 may change within each set as shown in FIG. 26. For example, the bristles may be centered in between the wire stem 55*a*, 55*b* and the length of the bristles may gradually shorten from one end 19 or 17 of the wires to the other end 17 or 19 giving a tapered appearance as shown in FIGS. 29 and 30. It is important that each individual transverse diameter in the tapered section is within the range defined by equation 1 below so as to define a proper gap space 3 to receive a patch 71. In some embodiments, the length of the bristles from one bristle to the next may gradually shorten then elongate and possibly shorten again, repeating this pattern to again form a sinusoidal pattern or jagged shape with pointed teeth as shown in FIG. 26.

Changing the sizes and positions of the bristles, for example, having staggered groups, improves the memory and resilience of the filament matrix that either brushes the bore 73 or holds the patch 71.

Figure 27:
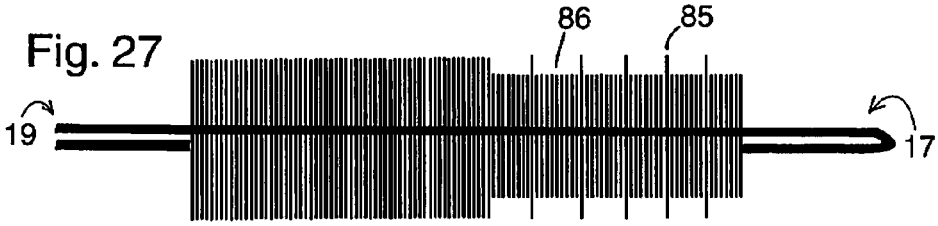
FIG. 27 shows a side view of another embodiment of the bristles and stem before the completion of the assembly.

In some embodiments, nested within a set of bristles 13 may be bristles of different length 85 intermittently spaced apart as shown in FIG. 27. For example, within a first set of bristles 86 may be individual long bristles 85 or groups of long bristles 85 intermittently spaced apart from other long bristles 85 or groups of long bristles 85. This allows the long bristles 85 to poke patches deep into edges 7 of grooves 4.

Figure 19:
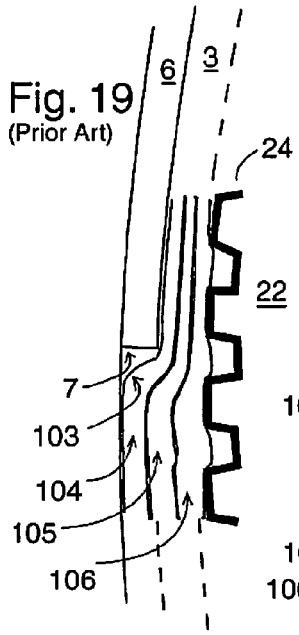
Fig. 19 (Prior Art)
FIG. 19 shows a close up view of a bore containing a cross section of a prior art jag with multiple layers of a patch inside the bore.
Figure 20:
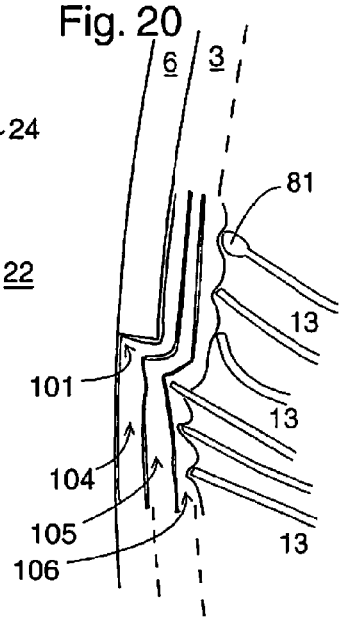
FIG. 20 shows a close up view of a cross section of a bore containing an embodiment of the present invention with multiple layers of patch inside a bore.
Figure 18:
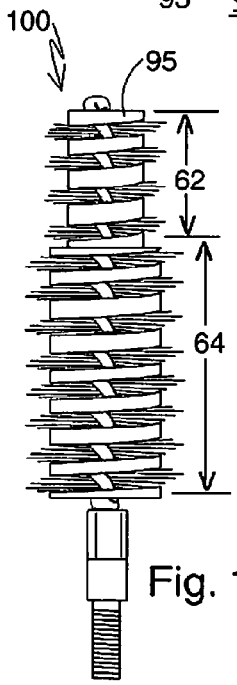
FIG. 18 shows another embodiment of the present invention.
Figure 21:
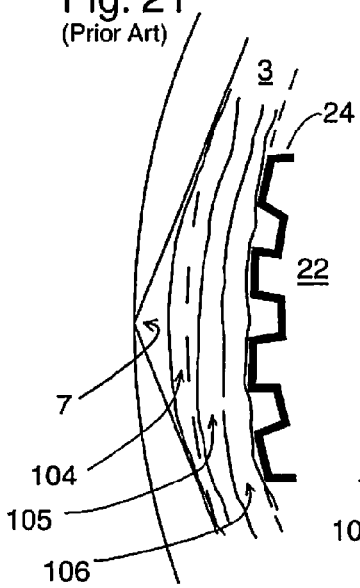
Fig. 21 (Prior Art)
FIG. 21 shows a close up view of a cross section of another type of bore containing a prior art jag with multiple layers of a patch inside the of bore.
Figure 22:
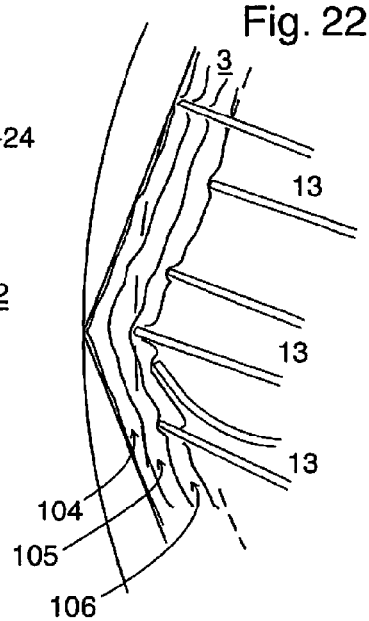
FIG. 22 shows a close up view of a cross section of another type of bore containing embodiment of the present invention with multiple layers of patch inside the bore.

By varying lengths of bristles 13 in the wiping section 62 of the proposed design, any number of average transverse diameters 61 may be created for any one particular proposed-design brush. Consider the cylindrical space 3 between the land diameter 1 feature of helical rifling and the surfaces of rigid bumps 24 of a solid jag 21 and 27. As shown in FIG. 19, the rigid knurls 24 of prior art jags do not poke into edges 7 at the base of lands 6 of conventional rifling. As shown in FIG. 21, the conventional jag also cannot reach into edges 7 of polygonal rifling. The bristles 13 of the brush and jag combination 100, however, can dig or embed into edges 7 of a bore having either the traditional rifling or the polygonal rifling, as shown in FIGS. 20 and 22. For example, while most bristles 13 in a wiping section 62 would create an average transverse diameter 61 smaller than the bores land-to-land diameter 8, some bristles 13 could create an average transverse diameter 61 between the laud-to-land diameter 8 and the inner wall diameter 1, and others could create an average transverse diameter 61 greater than the inner wall diameter 1.

As a result, an individual bristle 13 of the proposed design may push a tiny section of single-layered patch fabric 71 into edges 7, while a rigid knurl cannot. To push patch fabric 71 into the edges 7, a rigid knurl 24 of solid jags relies on multiple layers 104, 105, 106 of patch fabric pushing the outermost layer 104 into edges 7. Even so, the same kind of efficacy may never be reached because of the bunching that occurs. When a rigid bump makes multiple layers 104-106 of fabric bulge, the bulge 103 is smooth, rounded, large, and not able to reach into an edge 7. The proposed design, however is capable of pushing multiple layers 104 into edges 7 as shown in FIGS. 20 and 22. Furthermore, when a bristle of the proposed design bulges fabric, the bulge 101 may be sharp and small, especially when the bristle pokes one layer. A bristle may poke through inner layers 106 to reach the outer layer 104. The result is that the proposed design pushes fabric fully into edges 7 of rifling. The flexibility of bristles 13 of the proposed design allow it to form to any rifling shape, conventional type or polygonal type, and to any twist rate.

In addition, the flexibility of bristles 13 of the proposed design allows for a patch to reshape itself around the lifted ridges of the lands 6. The inflexibility of solid jags cause the familiar problem of too tight of a fit, causing too much force to be required to make a patch of recommended size to reciprocate inside the bore 73. The flexibility of the bristles 13 of the proposed design, on the other hand, allows the combination brush and jag 100 to reciprocate greater patch area inside barrels, and the flexibility allows it to variably reduce friction between the patch 71 and bore wall 0 or land 6 when the patch fabric 71 forms multiple layers.

When too much force is required to stroke the bore 73 with a prior art jag, the jag may punch a large hole through the patch 71. In that case, the patch 71 remains stationary in the bore 73, and the jag continues down the bore 73 pushing or pulling nothing. The flexibility of bristles 13 that hold onto the patch 71 makes the proposed design less likely to puncture a patch.

In some embodiments, the bristles 13 may be altered to increase or decrease the likelihood that the bristle 13 can poke through any particular kind of fabric. For example, concerning multiple layers of fabric 104-106, bristles 13 may be sharpened so that they poke through multiple inner layers 105, 106 of fabric in order for filament tips to reach the outermost layer 104 or layers.

Figure 16:
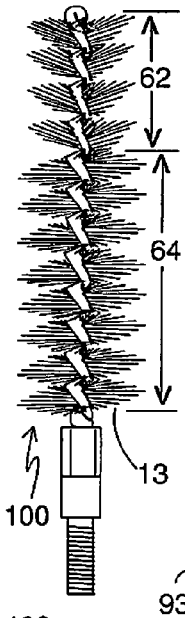
FIG. 16 shows another embodiment of the present invention.

In some embodiments, the bristles 13 are positioned on the stem 14 so as to project radially outward, perpendicularly from the stem 14. In some embodiments, the bristles 91 may be at pitch angles A (measured between the bristle and the longitudinal axis) other than ninety degrees to the longitudinal axis L of the stem 14, as shown in FIG. 16. For example, the pitch angle A may range from approximately 10 degrees to approximately 170 degrees. Preferably, the pitch angle A is between 45 degrees and 135 degrees. More preferably, the pitch angle A is between 60 degrees and 120 degrees.

Figure 15:
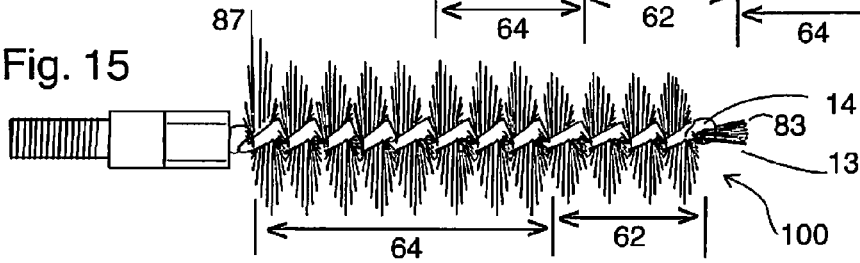
FIG. 15 shows another embodiment of the present invention.

The bristles in a small section or sections may be extended 87 in order to assist the proposed-design brushes in following the rifling, as shown in FIG. 15. The locations of multiple extensions 87 may be customized to help the brushes rotate with a particular fining's twist rate. Some bristles may be absorbent, such as having mop filaments mixed in with abrasive filaments. A mixture of abrasive bristles may be used, such as mixing more abrasive ones with less abrasive ones.

In some embodiments, the bristles 13 may be coated in order to improve their hold on patches 71, to affect the coefficient of friction between the bristles and the inner bore wall 0 and lands 6, or to affect filament memory. The tips of filaments 13, whether metallic, synthetic, absorbent, or composite, may be enhanced with abrasive or absorbent materials. For example tip of a filament may have a knob 81 as shown in FIG. 20. The knob 81 may be an abrasive or an absorbent. This embodiment may be used with or without a patch 71.

Figure 17:
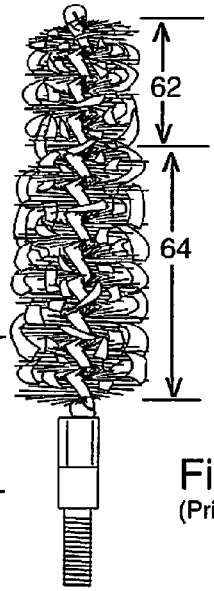
FIG. 17 shows another embodiment of the present invention.

In some embodiments, rather than bristles 13, the brush and jag combination 100 may be made entirely of abrasive ribbons 93, or it may have ribbons 93 wound or woven in with the filaments 13, as shown in FIG. 17. The ribbons 93 may be gauze or mesh made of metal, natural fiber, synthetic, or a composite.

The brush and jag combination 100 may be used to work with any kind of patch 71, swab, or wad material, with any kind of enhanced fabric or absorbent, and any kind of abrasive, and with material made by any technique. A non-exhaustive example of materials include, but are not limited to, any kind of cotton or derivatives thereof, such as flannel or twill or wads of loose fibers, any kind of wool or derivatives thereof, such as felt, or any material derived from polypropylene, from other synthetic resins, or from composites. Patches 71 may be coated or soaked with lubricant, solvent, preservative, or abrasive, whether natural or synthetic.

The patch 71 may be any shape. In the preferred embodiment, the patch 71 may have a generally rectangular, square, circular, or triangular shape. The patch 71 can be wrapped around a set of short bristles 62 in any fashion. In some embodiments, the center of the patch 71 is placed on the bend 18 at the first end 17 of the stem 14 and the remainder of the patch 71 is placed on the set of short bristles 62. To that effect, the patch 71 is dimensioned so that the edges of the patch 71 can fully cover a substantial portion of the set of short bristles 62. Covering a substantial portion of a set of short bristles 62 helps keep the patch 71 on the bristles 13 during use.

Figure 34:
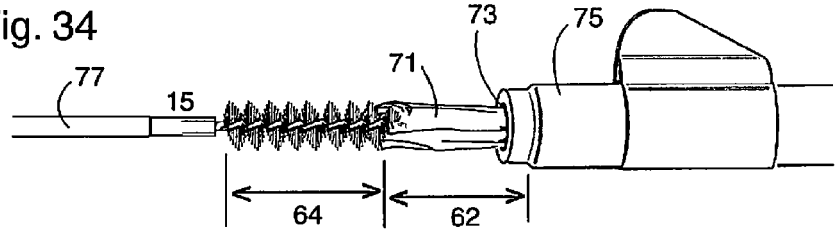
FIG. 34 shows an embodiment of the combination brush and jag being inserted into a bore.

The patch 71 may come in a variety of thicknesses. However, the dimensions of the brush and jag combination 100 and the dimensions of the patch 71 should correspond so as to substantially cover the set of short bristles 62 and still fit inside the bore 73 so that the set of short bristles 62 evenly distribute the patch 71 against the inner wall 0 or lands 6 of the bore 73. FIG. 34 shows the proposed design wrapped by a patch 71 being inserted into a bore 73 of a gun barrel 75.

The relationship between the bore diameter, the transverse diameter of the set of short bristles 61, and the patch thickness T may be defined by equation 1 as follows:

$$(BD-TD)=(c*T)*2,$$

where BD is the bore diameter (either inner wall diameter 1 or land-to-land diameter 8), TD is the transverse diameter 61 of the set of short bristles 62, T is the thickness of the patch 71, and c is constant less than or equal to 25. The preferred range for constant c is approximately 0.5 to 20. More preferably, the constant is between 0.5 and 5. Most preferably, c is 1.5. The constant determines the amount of friction applied to the bore 73. The gap space 3 is essentially (BD−TD)/2.

The relationship between the dimensions of the set of small bristles 62 and the patch 71 may be defined by equation 2 as follows:

$$R=(X)+\mathrm{Sqrt}((TD)^2/4+(B)^2),$$

where R is the radius 98 of a circular patch or the distance from the center to a corner of a square, rectangular, or triangular patch, X is length of the set of short bristles 62 along the longitudinal axis L, TD is the transverse diameter 61 of the short bristles 62, and B is the length 68 of the bend 18 along the longitudinal axis L. This equation also assumes the center of the patch 71 is placed on the bend 18 and forms generally a conical shape when wrapped around the set of short bristles 62.

The brush and jag combination 100 may further comprise a variety of connectors 15, such as rods, cables, ropes, shafts, and other devices to push and pull the brush and jag combination 100 through the bore. A non-exclusive list of examples includes, but is not limited, to, threaded connectors, latch-type connectors, snap-type connectors, slotted connectors, and locking connectors.

In some embodiments, the brush and jag combination 100 may further comprise a mounting connector 15 attached to both ends of the brush and jag combination 100, so that the brush and jag combination 100 can be put in series with other brush and jag combinations, prior art jags, prior art brushes, or with other cleaning devices, such as mops.

In some embodiments, the connector may be rotatably connected to the stem so as to allow the bristles 13 to swivel about the longitudinal axis L to allow for rotation with the rifling.

The brush and jag combination 100 may be printed, stamped, etched, or in way marked with information, such as caliber size. Alternatively the stem, bristles, and/or patch may be color coded to indicate proper caliber size.

The brush and jag combination 100 may also comprise a cover 95 like sleeves or armor, in order to expose only some of the bristles 13 or some portions of the bristles to increase filament memory and coefficient of friction. The cover 95 may be capable of holding abrasive material, or it may be abrasive through a roughened surface created by, but not limited to, ribs, nipples, knurls, bumps, or mesh.

The second end 19 of the brush and jag combination 100 may be adapted to receive other tools, such as power tools that assist in reciprocation, rotation, or vibration.

In some embodiments, the brush and jag combination 100 may have a tuft 83 of bristles 13 facing outward at the first end 17 of the stem 14 as shown in FIG. 15. The tuft 83 makes the jag and brush 100 a multi-purpose cleaning tool. For example, with the tuft 83, the combination 100 can brush and wipe the bore 73 in the same stroke, or it can brush and wipe other parts of the gun like the chamber. A patch 71 may be placed over die tuft 83 to perform the wiping function.

Figure 11:
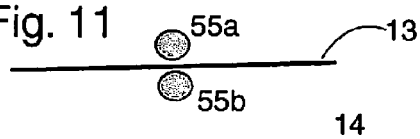
FIG. 11 shows rear view of the embodiment shown in FIG. 10.

The brush and jag combination 100 can be made by placing a plane of straight bristles 51 in between two parallel wire stems 55*a*, 55*b* as shown in FIGS. 10 and 11. The plane of filaments 51 may be held together by a thin tape (not shown). The combination is placed into a machine that twists the two wire stems 55*a*, 55*b* about one another. The machine may twist the wire stems from the first end 17 to the second end 19 or, from the second end 19 to the first end 17 to form the stem 14. The stem 14 is cut at the second end 19 and, may be attached to a connector 15 by crimping, gluing, bending the wire stems, or any other fastening means.

Another method of manufacturing the brush and jag combination 100 is to put the two wire stems 55*a*, 55*b* through the eye-let of a connector 15 before the wire stems 55*a*, 55*b* are twisted from the second end 19 to the first end 17. After the base wire 55 is twisted, the first end 17 may be cut short. In that case, the wire steins at the first end 17 of the brush are sharp where they were cut unless made smooth by grinding and brushing wheels.

The manner that planar packets of bristles 51 or coils of filaments are passed through the base wires 55, before twisting, may vary. For example, more than one filament may be used, one on each base wire.

Figure 28:
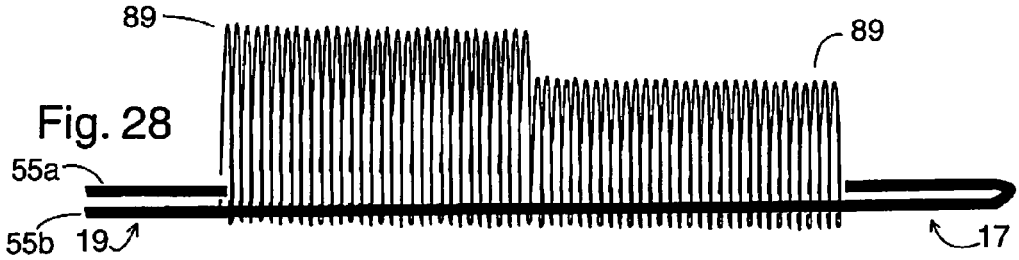
FIG. 28 shows a side view of another embodiment of the bristles and stem before the completion of the assembly.

Another kind of spiral bore brush is made, not using a plane of straight filaments, but using a coiled-wire spring 89 as shown in FIG. 28. Similar to the construction detailed in the above paragraph, the coiled-wire spring is pushed between two lengths of base wire 55*a*, 55*b*, and the two lengths are twisted. In other words, the coiled wire 89 may be wound about one of the wire stems 55*a* or 55*b* and then twisted between both. The final product does not press tips of filament strands 13 against the bore wall, but instead presses the sides of bent coiled filament wire against the bore wall. The proposed design may be made using coiled-wire springs in any manner that results in the product having more than one average transverse diameter. For example, two coils may be used, one resulting in a transverse diameter larger than the bore's inner diameter, and the other resulting in a transverse diameter smaller than the bore's inner diameter.

The changes in the lengths of the bristles 13 to create the different sets of bristles 62, 64 can be accomplished in a variety of ways. In some embodiments, a set of long bristles 64 and a set of short bristles 62 may be taped and laid sideby-side in between the stem wires 55*a*, 55*b*. Alternatively, the set of short and long bristles 62, 64 may be arranged accordingly before being taped.

In some embodiments, one set of bristles 51 having a uniform length may be laid in between the wire stems 55*a*, 55*b* as shown in FIG. 10. A group of bristles 51*a* may then be trimmed to the appropriate length to create the set of short bristles 62 as shown in FIG. 23. The tips of the filaments may be trimmed after the wire stems 55*a*, 55*b* are twisted in order to achieve any desired pattern. The creation of smaller radial diameters may be done, using trimming or grinding, after the stem 14 is made.

In use, a user may simply wrap the patch 71 around the set of short bristles 62 and plunge the brush and jag combination 100 in and out of a bore 73. In some embodiments, the user may let some of the patch 71 stretch into the set of long bristles 64. If the user lets too much of the patch 71 wrap around the set of long bristles 64, then the combination will be too large to fit into the bore 73 or will require too much force to make it stroke the bore 73. The amount of patch 71 allowed to go into the brushing region 64 of the proposed design depends on a user's preference.

Prior to use the brush and jag combination 100 may be sprayed, dipped, dunked, or exposed in any way to any kind of gas, liquid, or solid. The patch 71 may be coated or soaked with lubricant, solvent, preservative, or abrasive, whether natural or synthetic.

EXAMPLES

Examples of brush and jag combinations are given in FIGS. 23-28 and Table 1. The dimensions in Table 1 are in centimeters and the caliber is in U.S. units.

TABLE 1

| Filament Material | caliber | 63 average | 64 | 61 average | 61 max | 62 | Filament Diameter |
|---|---|---|---|---|---|---|---|
| Phosphor Bronze | 0.22 | 0.60 | 3.9 | 0.43 | 0.48 | 2.7 | 0.010 |
| Nylon | 0.22 | 0.60 | 3.9 | 0.43 | 0.48 | 2.7 | 0.026 |
| Phosphor Bronze | 0.30 | 0.81 | 3.5 | 0.63 | 0.67 | 2.9 | 0.010 |
| Nylon | 0.30 | 0.81 | 3.5 | 0.63 | 0.67 | 2.9 | 0.034 |
| Phosphor Bronze | 0.38 | 0.95 | 3.5 | 0.78 | 0.84 | 2.9 | 0.010 |
| Nylon | 0.38 | 0.95 | 3.5 | 0.78 | 0.84 | 2.9 | 0.039 |
| Phosphor Bronze | 0.45 | 1.20 | 3.5 | 1.04 | 1.09 | 2.9 | 0.015 |
| Nylon | 0.45 | 1.20 | 3.5 | 1.04 | 1.03 | 2.9 | 0.046 |
| Phosphor Bronze | 12 | 2.10 | 4.1 | 1.74 | 1.78 | 3.5 | 0.015 |
| Nylon | 12 | 2.10 | 4.1 | 1.74 | 1.78 | 3.5 | 0.065 |

The average dimension of a gap 3 created between the inner wall 0 and the set of short bristles 62 differs from a patch's 71 average thickness by a variable amount. If a nap 3 is too large, then the brush and jag combination 100 inside the bore 73 is not tight enough. If a gap 3 is too small, then the brush and jag combination 100 inside the bore 73 is too tight, requiring a stroking force so great that a component may break, damage the bore wall 0 or land 6, or require too much time and energy to complete the strokes.

Large caliber brush and jag combinations based on the proposed design may have a smaller average gap 3 because the brush and jag combination 100 accommodates multiple layering of a patch 71. The large cylindrical area created by bristle 13 tips of a large caliber brush and jag combination 100 allows a patch 71 to spread over the area without developing thick multiple layering. The long length of bristles 13 of large caliber brush and jag combination 100 allows them to bend more readily than shorter bristles when a patch 71 develops thick multiple layering, and in this way the multiple-layered patch 71 does not create too much tension inside the bore 73.

Averages for gap 3 dimensions, assuming a patch thickness of 0.0130 to 0.0210 inches, range ideally as follows: for 22 caliber, 0.019 to 0.025 inches; for 30 caliber, 0.023 to 0.028 inches; for 38 caliber, 0.024 to 0.034 inches; for 45 caliber, 0.012 to 0.023 inches; and for 12 gauge, 0.005 to 0.020 inches. The error fluctuation of filament 13 lengths typically ranges between 0.0020 inch to 0.0070 inches.

The brush and jag combination 100 is more efficient than the separate brushes and jags on the market because the user does not have to switch between alternate uses of the brush and the jag. In addition, both directions of a stroke brush and wipe simultaneously.

In the locations where the patch is applied, the proposed design has the additional feature of performing abrasion when bristles 13 poke through the patch fabric.

Due to precise dimensioning of the transverse diameter 61 of the set of short bristles 62 the brush and jag combination 100 applies absorbent material uniformly or entirely around the circumference of the bore wall 0 and/or land 6. In addition, the brush and jag combination 100 has the advantage of pressing the patch 71 at many contact points into the edges 7 of the grooves 4 and lands 6. The number of contact points can be much more than the number of contact points of a solid jag 21 with knurled surface 24 because typical filament diameters, being 0.005 inches, are smaller than typical knurled filament diameters, being 0.035 inches.

When undersized brushes wrapped in fabric are used to wipe bores, the transverse diameter of the brushes may be 0.0150 to 0.0800 inches less than the bore's inner diameter. This means the size of the gap 3 between bristle tips and bore wall averages from 0.0075 to 0.0400 inches. For caliber 45 and smaller, the average gap 3 measures 0.0075 to 0.0250 inches. A patch with average thickness 0.0150 inches will not fit into typical gaps 3 of 0.0075 to 0.010 inches because too much force would be required to make the combination stroke the bore. The user plays a game of trial and error to see if a particular make of undersized brush wrapped in fabric fits inside a particular larger caliber bore. Prior art brushes designed for the same caliber may not have the same average transverse diameter, and bores for the same caliber cartridge may not have the same inner bore diameter 1. Wrapping an undersized brush with a patch is a jerry-rigging since the brush was not designed to wipe bores, but rather it was designed to brush smaller bores. It addition, the maximum lengths of filaments 13 of undersized brushes are not long enough to reach into rifling grooves. When maximum lengths of filaments 13 of a prior art brush are long enough to reach inside rifling grooves, then the brush is not an undersized brush rather it would be a same-sized or an oversized brush, both of which are too tight inside the bore when wrapped by a patch.

The proposed designs are inexpensive to make since they use the same technology that current inexpensive twisted-wire stem 14 brushes use. The proposed designs in most cases do not require the construction of molds. The proposed designs work with current gun rods, cables, shafts, and their attachments since the proposed designs can be made to have the same connectors.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention not be limited by this detailed description, but by the claims and the equivalents to the claims appended hereto.

INDUSTRIAL APPLICABILITY

This invention may be industrially applied to the development, manufacture, and use of a combination brush and jag for the purpose of simultaneously brushing and wiping a bore. The combination brush and jag comprises a stem securing a set of long bristles and a set of short bristles, wherein the set of short bristles has a transverse diameter that is smaller than a transverse diameter of the set of long bristles. The transverse diameter of the set of short bristles is configured to be smaller than the bore. A patch may be wrap around the set of short bristles, such that the patch can wipe the bore while the set of long bristles simultaneously brush the bore.

What is claimed is:

1. A combination barrel brush and jag, comprising:

a. a set of short bristles, each bristle within the set of short bristles having a first length defining a first transverse diameter;

b. a set of long bristles, each bristle within the set of long bristles having a second length defining a second transverse diameter, the set of short bristles being adjacent to the set of long bristles;

c. a stem having a first end and a second end, the stem comprising a first wire stem, and a second wire stem parallel to the first wire stem, the stem defining a longitudinal axis parallel to the first and second wire stem, wherein the first and second set of bristles are positioned in between the first and second wire stem and fixed in place by a twist created by the first and second wire stems about each other along the longitudinal axis, wherein the first transverse diameter does not equal the second transverse diameter, and wherein the first transverse diameter is less than a bore diameter of a bore wall and the second transverse diameter is greater than or equal to the bore diameter;

d. a patch having a thickness configured to wrap around the set of short bristles, wherein the set of short bristles evenly distribute the patch against the bore;

e. wherein the patch has a shape selected from the group consisting of a rectangle, a triangle, a circle, and a square, and wherein the patch has a radius or distance from a center of the patch to a corner of the patch defined by equation 2.

2. The brush and jag combination of claim 1, wherein the set of short bristles is in between two sets of long bristles along the stem.

3. The brush and jag combination of claim 1, comprising multiple sets of short bristles separated by at least one set of long bristles.

4. The brush and jag combination of claim 1, further comprising a tuft of bristles positioned at the first end extending away from the second end.

5. The brush and jag combination of claim 1, wherein the first transverse diameter of the set of short bristles is smaller than the diameter of the bore wall so as to define a circular gap between the bore wall and the set of short bristles when the brush and jag combination is concentrically positioned inside the bore, wherein the distance between the set of short bristles to the bore wall is approximately 0.5 to 25 times the thickness of the patch.

6. The brush and jag combination of claim 1, wherein the set of short bristles and the longitudinal axis define an angle of approximately 10 degrees to approximately 170 degrees.

7. The brush and jag combination of claim 1, further comprising long bristles intermittently spaced apart within the set of short bristles.

8. The brush and jag combination of claim 1, wherein the set of short bristles comprises bristles of varying lengths.

9. The brush and jag combination of claim 1, wherein the set of short bristles comprises groups of bristles offset from an adjacent group of bristles.

10. A method of simultaneously brushing and wiping a bore, comprising:

a. providing a cleaning device, comprising:

i. a set of short bristles, the set of short bristles comprising a plurality of bristles having a first length defining a first transverse diameter;

ii. a set of long bristles, the set of long bristles comprising a plurality of bristles having a second length defining a second transverse diameter, the set of short bristles being adjacent to the set of long bristles; and iii. a wire having a first end and a second end, the wire comprising a first wire stem, and a second wire stem parallel to the first wire stem, the wire defining a longitudinal axis parallel to the first and second wire stem, wherein the short and long set of bristles are positioned at an angle between approximately 10 degrees to approximately 170 degrees relative to the first and second wire stems and fixed in place by a twist created by the first and second wire stems about each other along the longitudinal axis, wherein the first transverse diameter does not equal the second transverse diameter, and wherein the first transverse diameters is less than a bore diameter and the second transverse diameter is greater than or equal to the bore diameter;

b. covering the set of short bristles with a patch, wherein the patch has a radius or distance from a center of the patch to a corner of the patch defined by equation 2; and c. sliding the cleaning device into and out of the bore repeatedly in successive action thereby simultaneously brushing and wiping the bore.

11. The method of claim 10, further comprising exposing the patch to a fluid selected from the group consisting of a lubricant, a solvent, a preservative, and an abrasive.

* * * * *